US006420969B1

(12) United States Patent
Campbell

(10) Patent No.: US 6,420,969 B1
(45) Date of Patent: Jul. 16, 2002

(54) APPLIANCE ALARM SYSTEM

(76) Inventor: Kirk Campbell, 7981 La Riviera Dr., Sacramento, CA (US) 95826

( * ) Notice: Subject to any disclaimer, the term of this patent is extended or adjusted under 35 U.S.C. 154(b) by 0 days.

(21) Appl. No.: 09/568,574

(22) Filed: May 10, 2000

(51) Int. Cl.[7] ..... G08B 29/00; G08B 21/00

(52) U.S. Cl. ..... 340/506; 340/686.1; 340/539; 340/635; 340/585; 340/545.6; 307/139

(58) Field of Search ..... 340/506, 540, 340/541, 545.6, 585, 635, 686.1, 539; 307/139, 140

(56) References Cited

U.S. PATENT DOCUMENTS 3,886,534 A 5/1975 Rosen et al. ..... 340/517
4,446,455 A 5/1984 Nashawaty ..... 340/568
4,528,558 A * 7/1985 Steers et al. ..... 340/686.1
4,633,230 A 12/1986 Tam ..... 340/521
5,608,378 A 3/1997 McLean et al. ..... 340/540

* cited by examiner

*Primary Examiner*—Donnie L. Crosland
(74) *Attorney, Agent, or Firm*—Theodore J. Bielen, Jr.

(57) ABSTRACT

A system for arming and disarming a central intrusion alarm system control utilizing the activation status of a particular appliance. The system employs a detector for determining the position of an on-off switch associated with a particular appliance. The regulator prevents the operation of the arming control in a central intrusion alarm system when the detector determines that the appliance is "on". The system of the present invention may be employed with multiple appliance switches. In addition, transmission of the disarming signal to the central intrusion alarm arming control may be accomplished through hard wires or by radio transmission.

12 Claims, 3 Drawing Sheets

APPLIANCE ALARM SYSTEM

BACKGROUND OF THE INVENTION

The present invention relates to a novel and useful system for determining the state of activation of an appliance.

In the past, central alarm system have been employed to detect the intrusion of unwanted persons or things to a structure, such as a building, vehicle, edifice, and the like. Typically, intrusion alarm systems are triggered by breaches at a selected number of positions or points in the structure. In the case of a building, windows and doors are most often used for this purpose. Consequently, the central intrusion alarm system may not be armed unless all designated windows and doors are closed or set to a certain position. Typically, the closure of a door and window also operates magnetic contacts which serves as a switch to provide an activating signal or power to the central alarm arming control, which in turn arms the alarm system for use.

Moreover, an unattended heat-producing appliance has caused damage and loss of life, mainly through smoke and fire generation, to structures although fire alarms have been present.

Other events and objects have been used to activate alarms. For example, U.S. Pat. No. 4,633,230 shows an alarm system which includes a detector to monitor heat generated in a cooking container or a fire which, in turn, triggers an alarm through a burglar alarm system.

U.S. Pat. No. 3,886,534 describes a security system which is capable of operating a central alarm unit to multiple sensors in multiple locations. The sensors may detect the overheating of a stove, a fire, the presence of flooding, and the like to trigger an alarm.

U.S. Pat. No. 4,446,455 shows a stove alarm system which detects the on-off position of a burner control as well as the presence of a cooking utensil on the stove. The absence of a utensil on a burning stove activates an alarm.

U.S. Pat. No. 5,608,378 shows a sensor device which sends a warning light or sound when a door is opened with the burner of a stove being in the "on" position.

A system for preventing the activation of a central alarm system when an appliance is active would be a notable advance in the field of fire prevention.

BRIEF SUMMARY OF THE INVENTION

The present invention concerns a system for determining the state of activation of an appliance in conjunction with a central alarm system.

The system of the present invention is employed for determining the state of activation of an appliance which usually has a switch. The switch of the appliance is employed to turn the appliance on and off as well as to control the level of heat applied to the appliance. Appliance switches have operators which may take the form of a dial, a button, a rocker arm, and the like. The heat may derive from an electrical source, a gas source, a steam source, and the like. The system of the present invention is used in conjunction with an arming control found in an existing intrusional alarm system used in conjunction with a structure. The state of activation of the appliance is used to operate the arming control to diminish the possibility of an unsafe condition due to an appliance which is inadvertently left in the "on" position and in an unattended state.

The system includes detection means for determining the position of the on-off switch of the appliance. Such detection means may take the form of a pair of electrical conductors connected to the appliance switch. Preferably the conductors are connected parallel with an indicator light or a movable contact. In certain cases, the electrical conductors may directly interrupt the power to the central alarm arming control. For example, a dial-type appliance switch operators may prevent arming of a central alarm when contacts on the dial are separated. Push-in dials may also be employed with the present invention. In other cases, a relay may be employed to react to an appliance's electrically active condition (in the case of an electrically operated appliance switch), such as an indicator light, and, again, interrupt the power or signal to the intrusion alarm arming control. A multiplicity of appliance switches may be connected in series, as well as a multiplicity of appliance switches from an assortment of appliances. For example, a non-electrical gas range set of controls may be combined with electrical switches used to operate an electric oven.

Regulation means is also included in the present invention for preventing the operation of the arming control for the intrusion alarm, when the detection means determines the on-off switch of a particular appliance is in the "on" position. Vice versa, the regulation means allows the operation of the arming control for the intrusional alarm when the detection means determines the on-off switch of the appliance is in the "off" position. Where an electrical relay is employed, the detection means would operate the solenoid portion of the relay. When a signal, such as an electrical current, is received by the solenoid, the regulation means would include a pole to open a circuit linked to the arming control of the intrusion alarm. Absent such detector means signal, the pole of the relay would close, permitting the alarm arming control to operate. Thus, the relay hereinabove described would be a normally closed relay. Multiple relays may be connected in electrical series, each relay being capable of receiving a signal from the detection means. Thus, any appliance switch in the "on" position produces such a signal to prevent the intrusion alarm arming control to operate.

Another aspect of the present invention employs a central intrusion alarm system in which the alarm arming control is operated by a switch that is radio controlled. That is to say, a "wireless" central intrusion alarm system is also employed in the present invention. In such a case, the regulation means would include a radio transmitter that generates a radio signal when the on-off switch of an appliance is in the "on" position. Needless to say, receipt of such radio signal by the radio operated receiver switch of the intrusion alarm control would open the circuit to the alarm arming portion and prevent the central alarm system from working. Again, a plurality of such radio transmitters, each associated with an on-off switch of an appliance, may be employed. In certain cases, multiple appliance switches may be wired in series to a single transmitter.

It may be apparent that a novel and useful system for linking an appliance activity state to an alarm system has been hereinabove described.

It is therefore an object of the present invention to provide a system for linking the activation state of an appliance to an alarm system which may be easily retrofitted to existing central alarm and heat producing appliances found in a structure.

Another object of the present invention is to provide a system for linking the activation state of an appliance to a central alarm system which is capable of alerting the user to an unsafe condition which may potentially cause damage to the structure.

A further object of the present invention is to provide a system for using the activation state of an appliance to control a central alarm system which is capable of operating in conjunction with appliances that are electrically controlled and those which do not employ electricity for its operation.

Another object of the present invention is to provide a system for linking the state of activation of an appliance to a central alarm system which is capable of operating in conjunction with a plurality of appliance switches.

The invention possesses other objects and advantages especially as concerns particular characteristics and features thereof which will become apparent as the specification continues.

Figure 1:
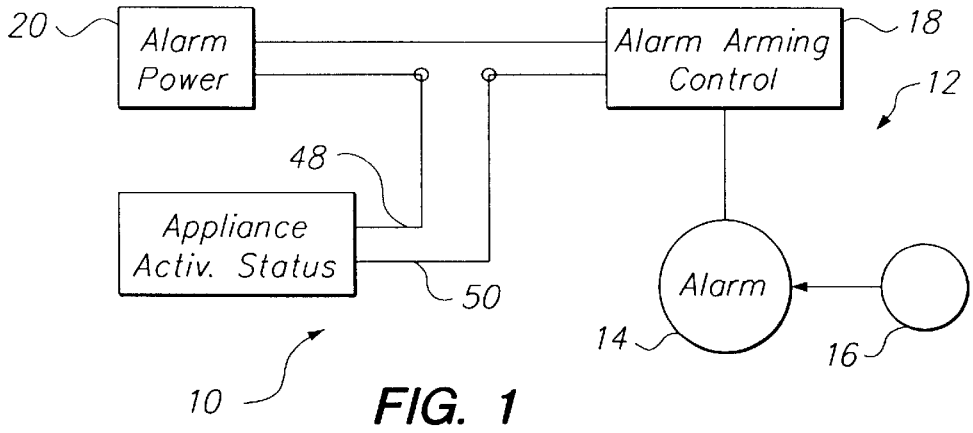
FIG. 1 is a schematic view showing the overall interaction between the activation state of an appliance and a central intrusion alarm system.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove-delineated drawings.

The invention as a whole is shown in the drawings by reference character 10. System 10 is intended to be employed with a central intrusion alarm system 12, FIG. 1 which is known in the prior art. Essentially, central alarm system 12 includes an alarm mechanism 14 which may be visual, audio, or an electronic signal to an authority such as a police department and the like. Alarm mechanism 14 is activated by an intrusion signal 16 which may take the form of an open door, a broken window, and the like. Alarm mechanism 14 is only capable of working after alarm arming control 18 is set. That is to say, alarm power or signal 20 is sent to alarm 14 via control 18 when all positions of possible intrusion are properly secured. For example, when windows and doors are closed properly, alarm mechanism 14 is armed and ready to detect intrusion 16, should it occur. System 10 of the present invention prevents alarm system 12 from being armed if a control switch of particular appliance, such as a stove, broiler, oven, and the like is in the "on" position. That is to say, system 10 would alert persons in attendance of a structure to not leave the structure until appliances used in the system 10 of the present invention are in the "off" position.

Figure 2:
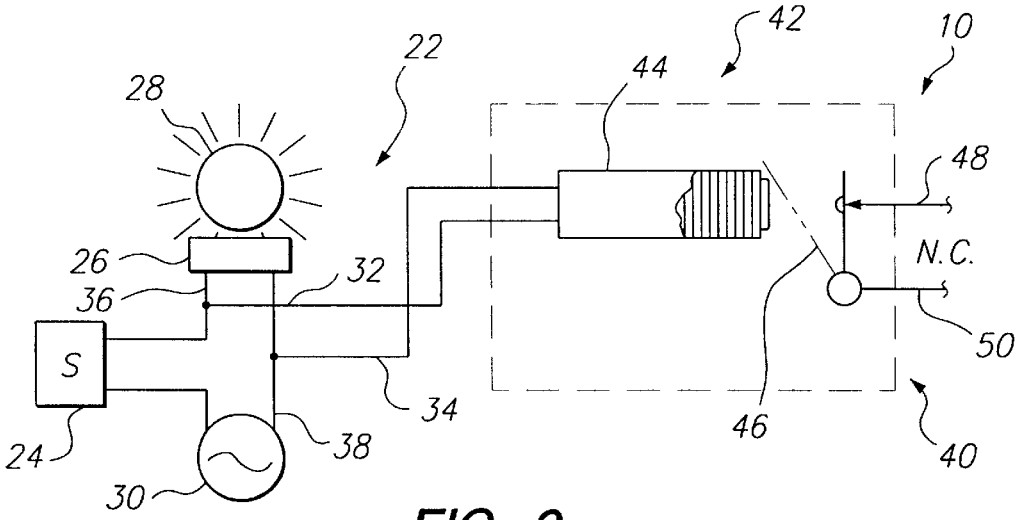
FIG. 2 is a partial electrical schematic indicating the operation of the detection and regulation means of the present invention.

Turning to FIG. 2, it may be seen that system 10 of the present invention includes detection means 22. Detection means 22 is used in conjunction with an appliance switch 24 which operates an appliance 26, having an indicator light 28 in certain cases. Power for appliance 26 derives from power source 30. Detection means 22 includes a pair of conductors 32 and 34 which tap into conductors 36 and 38, that only carry electrical current when switch 24 is "on".

Regulation means 40 shown in the form of a single pole relay 42. Conductors 32 and 34 pass electrical current to solenoid 44. Relay 42 is normally closed (N.C.). However, when switch 24 is "on" the solenoid 44 is activated, opening relay 42 such that pole 46 travels to solenoid 44. Conductors 48 and 50 linked to alarm system 12 interrupt the power or signal 20 to alarm arming control 18. It should be noted that other components such as relays within central alarm system 12 may produce the same effect. That is to say, the opening of relay 42 will prevent alarm system 12 arming control 18 to activate alarm system 12. Of course, when switch 24 is in the "off" position, relay 42 closes and alarm arming control 18 is capable of operating in the usual manner to activate alarm mechanism 14. It should be noted that indicator light 28 is not necessary to the operation of regulation means 40.

Figure 3:
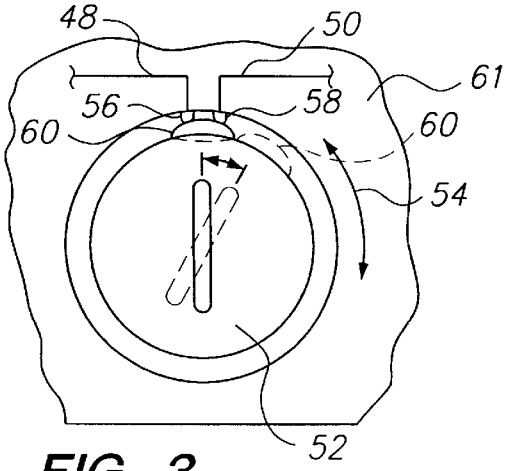
FIG. 3 is a front plan view of a control on a gas range which includes detection means of the present invention.
Figure 4:
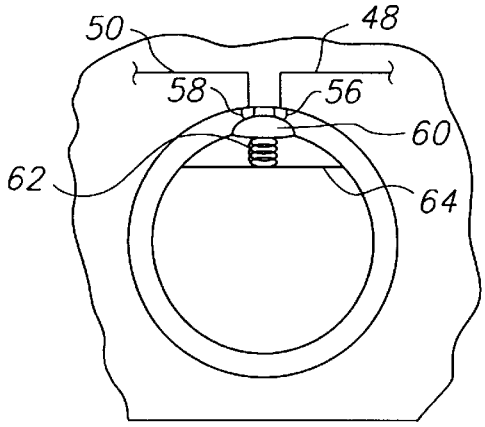
FIG. 4 is a rear view of the control depicted in FIG. 3.

FIGS. 3 and 4 show a typical non-electrical control for a non-electrical appliance such as a gas range, oven, and the like. Control or dial 52 is rotatable according to directional arrow 54. A pair of conductors or contacts 56 and 58 touch a conductive contact 60 when rotatable dial 52 is in the "off" position, as shown in FIG. 3. Contact 60 may be forced to touch contacts 56 and 58 by the use of spring 62. Spring 62 may be supported on a shelf or ridge 64 at the rear of dial 52 on housing 61. It should be noted that conductors 48 and 50 again travel to alarm system 12 as depicted in FIG. 1. Returning to FIG. 3, it may be observed that the turning of dial 52 slightly clockwise has moved contact 60 from a position where it no longer touches both contacts 56 and 58. This position, of course, will prevent alarm arming control 18 from operating.

Figure 5:
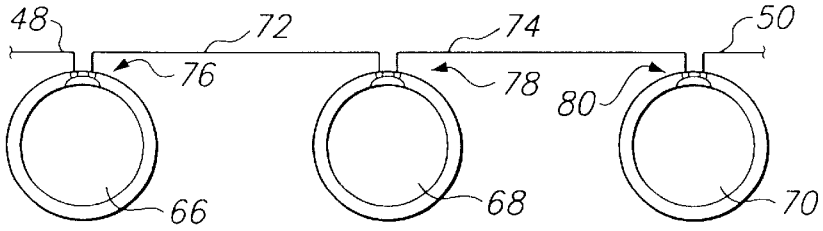
FIG. 5 is a schematic view indicating the linking of three controls for a gas range.

Turning to FIG. 5, it may be observed that a trio of dials, switches, or controls 66, 68, and 70 are employed in the present invention. Conductors 72 and 74 complete an electrical series connection between the plurality of contacts 76, 78, and 80, of dials or controls 66, 68, and 70, respectively. Thus, the turning of any one of the dials 66, 68, or 70 to an "on" position would prevent the arming of alarm 12 by alarm arming control 18.

Figure 6:
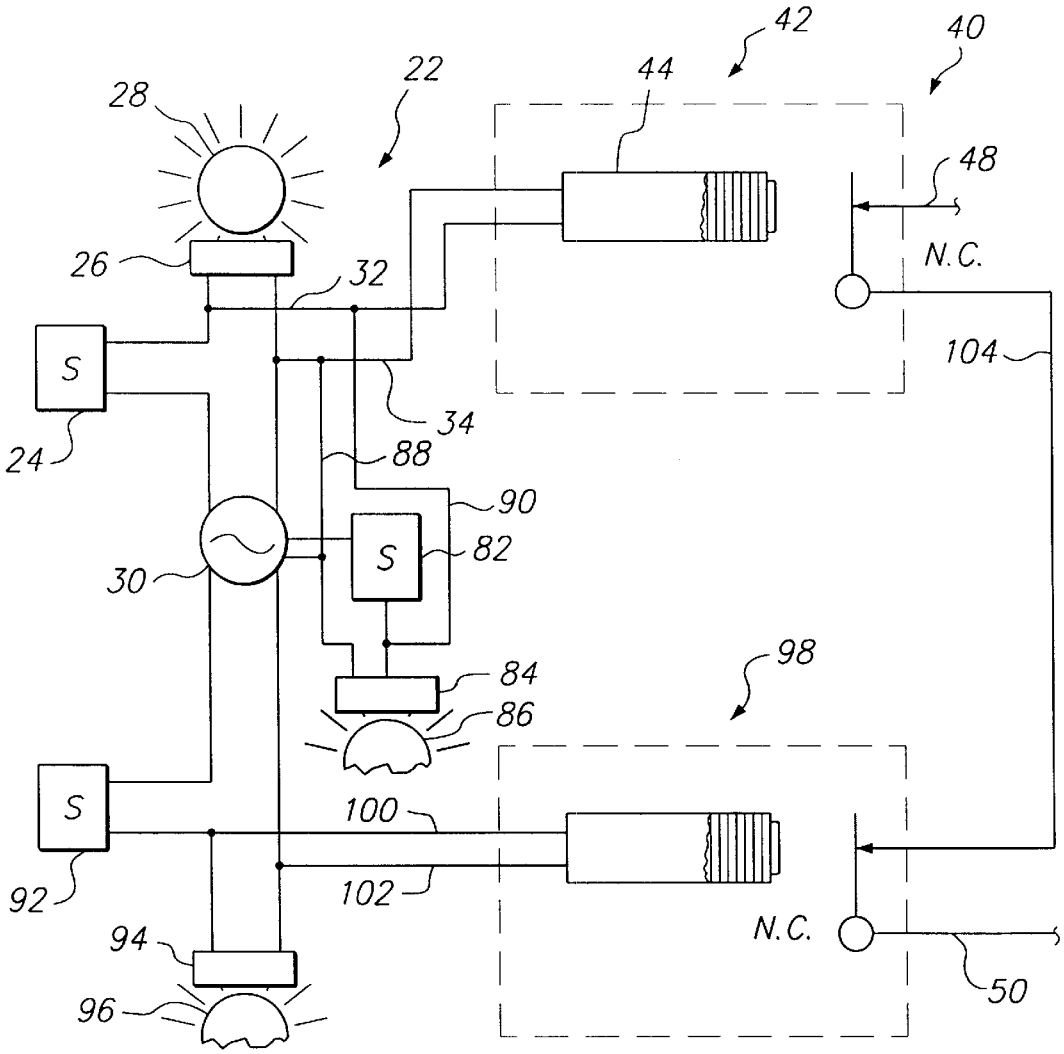
FIG. 6 is a schematic indicating multiple electrical appliance switches and showing alternate methods of linking the same together to control a central alarm system.

With reference to FIG. 6, it may be seen that the detection means 22 and regulation means 40 of FIG. 2 are shown in conjunction with switch 82 operating appliance 84 having an indicator light 86. Conductors 88 and 90 tap into conductors 32 and 34 to permit either switch 24 or switch 82 to operate relay 42 as heretofore described with respect to FIG. 2. In addition, switch 92 for appliance 94 having indicator light 96 is linked to another relay 98 via conductors 100 and 102. Conductor leg 104 places relays 42 and 98 in series. Thus, the operation of either one of relays 42 or 98 will interrupt the alarm power to alarm arming control 18 via conductor legs 48 and 50.

Figure 7:
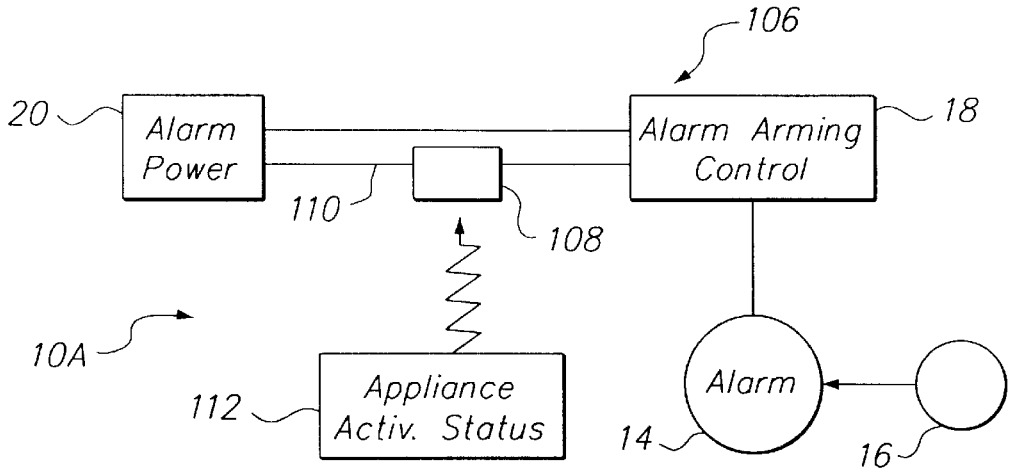
FIG. 7 is a schematic view depicting the operation of a radio controlled central alarm system with a radio transmitter employed in the present invention.
Figure 8:
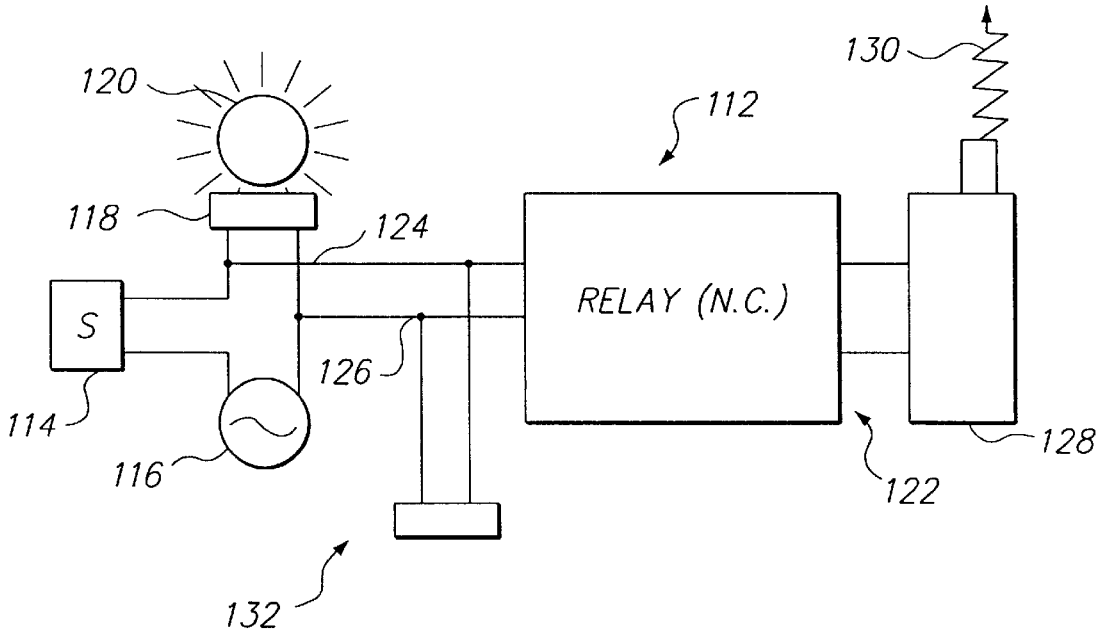
FIG. 8 is a schematic view indicating the operation of the detection means and regulation means of the system depicted in FIG. 7.

Turning now to FIGS. 7 and 8, embodiment 10A of the present invention is shown. Alarm system 106 includes alarm arming control 18 and alarm mechanism 14. However, radio receiver switch 108 interrupts leg 110 between alarm power or signal and alarm arming control 18. Embodiment 10A of the present invention includes a transmitter system 112 which indicates that an appliance switch is in the "on" position. Appliance switch 114 derives power from power source 116 to operate appliance 118, which may or may not include an indicator light 120. It should be realized, that indicator light 120 is not necessary for the operation of embodiment 10A depicted in FIGS. 7 and 8 of the system of the present invention. A normally closed (N.C.) relay 122 receives current through conductors 124 and 126 when switch 114 is in the "on" position. The opening of relay 122 activates a signal transmitter 128 which sends a signal 130 that is received by radio receiver switch 108 of central alarm system 106. For example transmitter 128 may take the form of a Lynx Model manufactured by Ademco, of Syosset, N. Y. With certain transmitters 128, relay 122 may be normally open. Another appliance 132, wired similarly to appliance 84 of FIG. 6 may operate relay 122. When such signal is received, the switch 108 opens, interrupting the alarm power or signal 20 connection with alarm arming control 18. Thus, alarm 14 will not operate until switch 114 is closed in the "off" position.

In operation, the alarm system 12 and 106 of FIGS. 1 and 7 are controlled by the status of an appliance such as appliance 26 of FIG. 2. That is to say, when switch 24 of appliance 26 is in the "on" position, relay 42 interrupts alarm power 20 to alarm arming control 18 and prevents alarm system 12 from becoming active. Turning switch 24 into the "off" position, will permit alarm arming control 18 to arm central intrusion alarm system 12. The dial system such as dial 52 of FIGS. 3, 4, and 5, will permit system 10 of the present invention to operate with non-electrical controls such as those found with gas ranges-and ovens. Multiple controls may be linked together, as long as the conductors 48 and 50 to alarm arming control 18 is interrupted when a particular appliance control is in the "on" position. Alarm arming control 18 of central alarm system 106 of FIGS. 7 and 8 may be controlled in the same manner except that the signal to switch 108 is transmitted through radio waves rather than by hard wires such as conductors 48 and 50. Presumptively, the user of systems 10 or 10A will note that the alarm for a structure, be it system 12 or 106 is not capable of arming. Consequently, the user of systems 10 or 10A will investigate the status of any appliance linked to system 10 or 10A to insure that the appliances in the "off" position before leaving the structure. Also, "appliances" may be assigned a particular zone on many central intrusion alarm systems. Moreover, such appliance zone may be bypassed at the predilection of the user.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A system for using the state of activation of an appliance having at least one on-off switch to operate an arming control for an intrusion alarm for a structure, comprising:

a. detection means for determining the position of the on-off switch of the appliance; and b. regulation means for preventing the operation of the arming control for the intrusion alarm when, said detection means determines the on-off switch of the appliance is in the "on" position and allowing the operation of the arming control for the intrusion alarm when said detection means determines the on-off switch of the appliance is in the "off" position.

2. The system of claim 1 in which said regulation means includes an electrical relay having a solenoid switch operating a pole to open and control the intrusion alarm.

3. The system of claim 2 in which said detection means includes a pair of electrical conductors connected to the appliance switch and to said relay solenoid switch.

4. The system of claim 1 in which the appliance includes a plurality of on-off switches and said detection means determines the position of any of the plurality of on-off switches.

5. The system of claim 4 in which said regulation means includes at least one electrical relay having a solenoid switch operating a pole to open and close a circuit linked to the arming control of the intrusion alarm.

6. The system of claim 5 in which said detection means includes a pair of electrical conductors connected to at least a pair of appliance switches and a third conductor connecting said pair of switches in series, said third conductor positioned in series between said first and second conductors being connected to said relay solenoid switch.

7. The system of claim 5 in which said regulation means includes another electrical relay having a solenoid switch operating a pole to open and close said circuit linked to the arming control of the intrusion alarm.

8. The system of claim 7 in which said detection means includes a first pair of electrical conductors connected to one appliance switch and said one relay, and a second pair of electrical conductors connected to said another appliance and said another electrical relay.

9. The system of claim 1 in which the arming control for an intrusion alarm includes a radio operated switch, and said regulation means further comprises at least one radio transmitter, said radio transmitter generating a radio signal received by the radio operated switch when the on-off switch of an appliance is in the "on" position, preventing operation of the arming control for the intrusion alarm.

10. The system of claim 9 in which said regulation means includes a plurality of radio transmitters, each associated with an on-off switch of an appliance.

11. The system of claim 1 in which said regulating means includes a pair of conductors associated with the on-off switch of the appliance.

12. The system of claim 4 in which the arming control for an intrusion alarm includes a radio operated switch and said regulation means includes at least one radio transmitter, said radio transmitter generating a radio signal received by the radio operated switch when any of the on-off switches of the appliance is in the "on" position, preventing operation of the arming control for the intrusion alarm.

* * * * *